US009550232B2

(12) United States Patent
De Monte et al.

(10) Patent No.: US 9,550,232 B2
(45) Date of Patent: Jan. 24, 2017

(54) ELECTROMAGNETIC STIRRING DEVICE

(71) Applicant: ERGOLINES LAB S.R.L., Trieste (IT)

(72) Inventors: Stefano De Monte, Trieste (IT); Stefano Spagnul, Trieste (IT)

(73) Assignee: ERGOLINES LAB S.R.L., Trieste (IT)

( * ) Notice: Subject to any disclaimer, the term of this patent is extended or adjusted under 35 U.S.C. 154(b) by 96 days.

(21) Appl. No.: 14/402,756

(22) PCT Filed: May 22, 2013

(86) PCT No.: PCT/EP2013/001507

§ 371 (c)(1),
(2) Date: Nov. 21, 2014

(87) PCT Pub. No.: WO2013/174512

PCT Pub. Date: Nov. 28, 2013

(65) Prior Publication Data

US 2015/0151355 A1 Jun. 4, 2015

(30) Foreign Application Priority Data

May 24, 2012 (IT) ..... UD2012A0095

(51) Int. Cl.

| | |
|---|---|
| ***B22D 11/12*** | (2006.01) |
| ***B22D 11/115*** | (2006.01) |
| ***B01F 13/08*** | (2006.01) |
| ***B22D 11/124*** | (2006.01) |

(52) U.S. Cl.
CPC ..... *B22D 11/122* (2013.01); *B01F 13/08* (2013.01); *B22D 11/115* (2013.01); *B22D 11/124* (2013.01); *B01F 2215/0044* (2013.01)

(58) Field of Classification Search
CPC ..... B22D 11/115; B22D 11/122; B22D 11/124
See application file for complete search history.

(56) References Cited

U.S. PATENT DOCUMENTS

2008/0164004 A1 7/2008 Kolesnichenko et al.

FOREIGN PATENT DOCUMENTS

| | | | |
|---|---|---|---|
| CN | 201482974 | U | 5/2010 |
| DE | 2720391 | A1 | 12/1977 |
| EP | 2127783 | A1 | 12/2009 |

OTHER PUBLICATIONS

International Search Report for corresponding International Application No. PCT/EP2013/001507.

*Primary Examiner* — Kevin P Kerns
*Assistant Examiner* — Steven Ha
(74) *Attorney, Agent, or Firm* — Egbert Law Offices, PLLC

(57) ABSTRACT

An electromagnetic stirring device of melted metallic materials inside a cooling chamber of a casting machine having a retaining body of induction coils that is a body composed of at least two reciprocally different portions.

28 Claims, 10 Drawing Sheets

ELECTROMAGNETIC STIRRING DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an electromagnetic stirring device (1) of melted metallic material inside a cooling chamber (30) of a casting machine (18) according to the characteristics of the pre-characterizing part of claim 1.

This invention relates also to a casting machine (18) according to the characteristics of the pre-characterizing part of claim 17.

The present invention also relates to a casting process for the production of metallic material bars (16) according to the characteristics of the pre-characterizing part of claim 20.

Definitions

Herein description and in the appended claims the following terms must be intended according to the definitions given in the following.

With the expression "metallic bar" it is intended to include all types of products of a casting machine, e.g. billets, blooms or flat blooms with different shapes in section e.g. with square, rectangular, round, polygonal section.

With the expression "casting machine" it is intended to include both vertical casting machines and casting machines provided with bending.

2. Description of Related Art Including Information Disclosed Under 37 CFR 1.97 and 37 CFR 1.98.

In the field of the execution of continuous casting plants of metallic materials, in general steels and metallic alloys, the recourse to electromagnetic stirring devices of the melted metallic material generally known with the name of stirrers, is known.

The stirrer produces a magnetic field generating a force inside the die or mould within which there is the melted metallic material inducing a rotating flow inside the melted bath obtaining a stirring effect of the same. In the die or mould occurs the cooling of the surface or skin of the metal bar that is generated in the die itself and, in correspondence with the outlet of the metal bar from the die or mould, it presents a solidified perimetrical zone or shell having a 10-30 mm thickness inside which there is a nucleus in which the metallic material is still at the melted state and that is progressively solidified when the metallic bar advances within a cooling chamber of the casting machine in which it is subject to the action of cooling groups that in general consist of sets of water sprayers. Applications of the stirrers both in correspondence with the die or mould within which the introduction of the melted metallic material occurs and applications of the stirrer at the cooling chamber of the casting machine to obtain qualitative improvements of the metallic bar structure to reduce the occurrence of deficiencies during the solidifying phase are known. The stirrer consists of a housing inside which some electrical windings are placed for the passage of the current that induces the electromagnetic stirring field and the housing presents an open duct within which the incandescent metallic bar in the formation process passes. For example the recourse to the stirrers contributes to reduce inclusions and surface and subcutaneous blowholes, cracks, porosity, segregation and contributes to improve the solidifying structures.

The prior art stirrers are usually mounted in fixed position determined on the basis of the characteristics of the casting machine and of the process according to a solution of compromise between the optimal different positions that would be required according to the process variations and to the sections of the cast metallic bars.

The Patent Application EP 2127783 A1 describes an electromagnetic stirrer that is intended to be installed around the steel discharger from the tundish to the mould of a continuous casting machine, in which the electromagnetic stirrer including a nucleus composed of two different circumferential portions around which a plurality of windings is wound.

The Patent Application US 2008/164004 A1 describes an electromagnetic stirrer that is intended to be installed along different billet portions in the process of production in a continuous casting machine.

Problems of the Prior Art

The stirrers that are applied inside the cooling chamber and that operate on the still melted nucleus present internally to the metal bar in the formation process have some drawbacks. First of all the position in which the stirrer is applied remains fixed for the whole process. Since its effect on the still melted nucleus depends strongly on the solidifying phase in which the metallic bar is found at the installation zone of the stirrer itself, it isn't possible keeping into account variations of the solidifying conditions that may happen for example due to variations in the casting temperatures of the melted metallic material in the die or mould, to the extraction speed of the bar in the formation process, to the section shrinkage along the casting line, to the composition of the metallic material, etc. Consequently in the prior art techniques the effectiveness of the stirrers applied in the cooling chamber is often compromised because the positioning of the stirrer along the bar in the formation process is the result of a compromise that does not keep into account the real conditions that may occur during the casting phase and that can change continuously.

Furthermore during the casting phase different drawbacks may occur that can damage gravely and irreparably the stirrers applied in the cooling chamber. For example during the casting may happen a phenomenon known with the name of break-out that involves the breakage of the skin or of the solid shell containing the metallic material nucleus still at the melted state. Consequently the melted metallic material nucleus exits from the bar in the formation process and outflows within the casting chamber with the consequence that it may run over the stirrer and definitively compromise its functionality for prolonged time periods. In fact in case of damage it will be necessary to remove the stirrer from the casting machine and to provide to its replacement or to its repair that could involve long times during which the functionality of the stirrer cannot be used. Further problems are liable to occur in case of interruption of the electrical energy feeding for the casting machine functioning. In this case the cooling devices of the stirrer interrupt the cooling liquid flow leaving the stirrer exposed to the heat coming from the metallic bar that remains blocked in the passage duct inside the stirrer with the risk of serious damages to the stirrer internal windings.

Furthermore the prior art techniques providing the presence of stirring devices within the casting chamber have problems from the point of view of the casting machine set-up times because their position should be modified according to the process parameters, e.g. according to the metal alloy that is cast, to the shape in section of the bar that is produced and to the size in section of the bar itself. However it is not always possible to ensure the correct positioning of the stirrers in correspondence with the estimated optimal point for the action of the stirrer and sometimes the optimal positioning of the stirrer must be wasted to increase the machine fitting-out times, involving, therefore, not-optimal results.

Furthermore the movement of the stirrers during the casting process is not possible because of the presence of the support mechanisms of the casting machine that would prevent their sliding because of the interference problems between the body of the stirrer and the same mechanisms.

Aim of the Invention

The aim of this invention is to supply a stirrer intended to be applied within the cooling chamber of a casting machine that allows a greater effectiveness in the stirring action with respect to the stirring devices of the prior art.

Further aim of the present invention is to allow an effective positioning of the stirrer in the optimal operative zone according to the operative parameters of the casting in progress.

Further aim of the present invention is to supply a stirrer endowed with safety means that in emergency conditions allow to put in safety the stirrer itself in these conditions.

BRIEF SUMMARY OF THE INVENTION

The aim is reached with the characteristics of the main claim. The sub-claims represent advantageous solutions.

Advantageous Effects of the Invention

The solution in accordance with the present invention, by the considerable creative contribution the effect of which constitutes an immediate and not-negligible technical progress, presents various advantages.

With the solution according to the present invention applied to a casting machine, obtaining products of the casting machine in the form of bars having the best quality with respect to the bars made by casting machines equipped with traditional stirrers, is possible.

Moreover with the solution according to the present invention obtaining a more protected stirrer with reference to emergency conditions that may happen inside the cooling chamber of the casting machine e.g. in the case of break-out, namely breakage of the skin or shell of the metal bar in the formation process, or interruption of the feeding electric current of the same casting machine apparatuses is possible.

Furthermore with the solution according to the present invention it is possible a faster fitting-out of the casting machine according to the process parameters, e.g. according to the metal alloy that is cast, to the shape in section of the bar that is produced and to the size in section of the same bar. A fast fitting-out of the machine has important implications from the economical point of view because prolonged stop times endanger the reaching of large production amounts with consequent minor exploitation of the production capacity of the casting machine and less results.

BRIEF DESCRIPTION OF THE DRAWINGS

It is in the following described a solution realizable with reference to the included drawings to be considered namely non-limited example of the present invention in which.

DETAILED DESCRIPTION OF THE INVENTION

Figure 1:
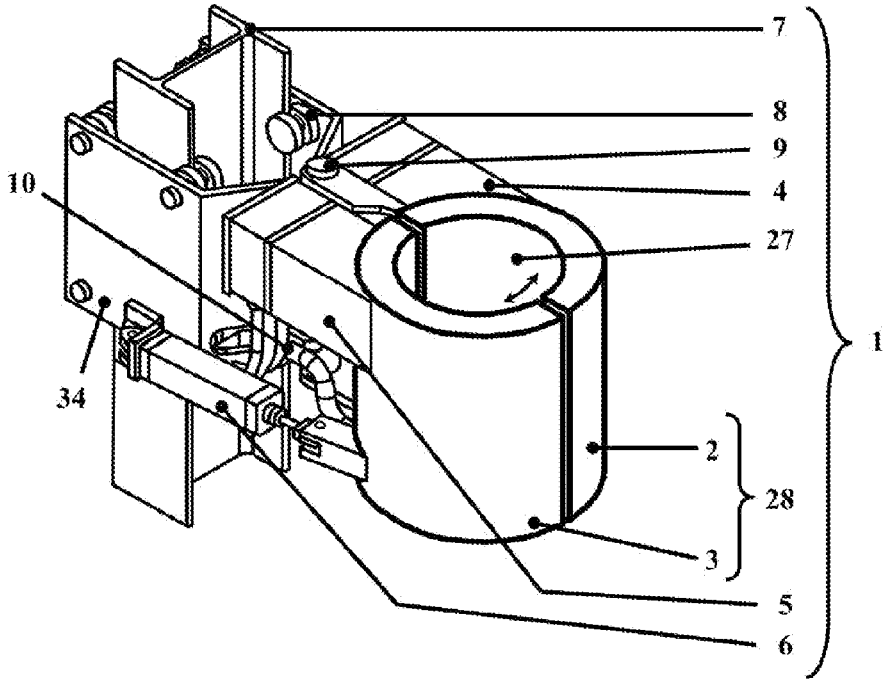
FIG. 1 represents schematically a three-dimensional view of the stirrer made in conformity with the present invention in closing condition of the stirrer body.
Figure 2:
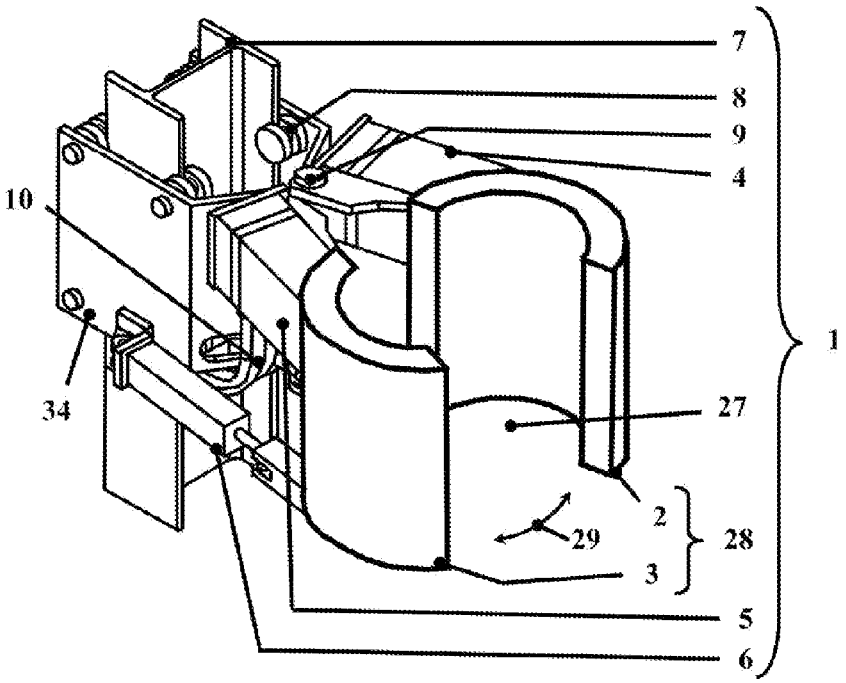
FIG. 2 represents schematically a three-dimensional view of the stirrer of FIG. 1 in opening condition of the stirrer body.
Figure 3:
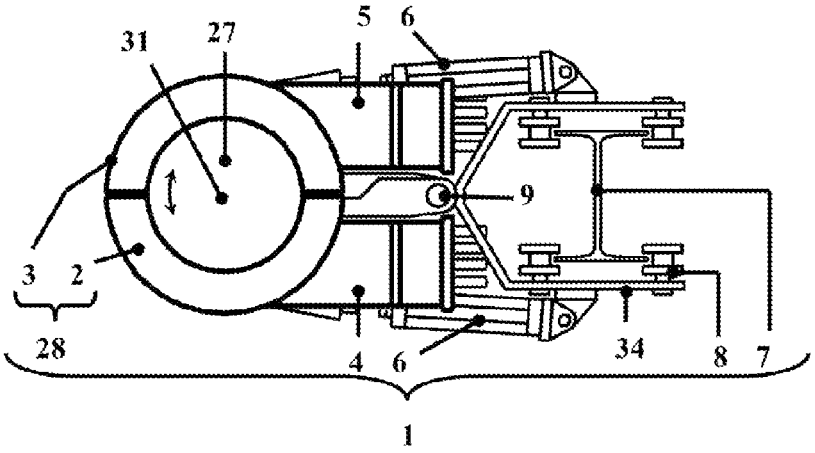
FIG. 3 represents schematically a plan view of the stirrer of FIG. 1 in closing condition of the stirrer body.
Figure 4:
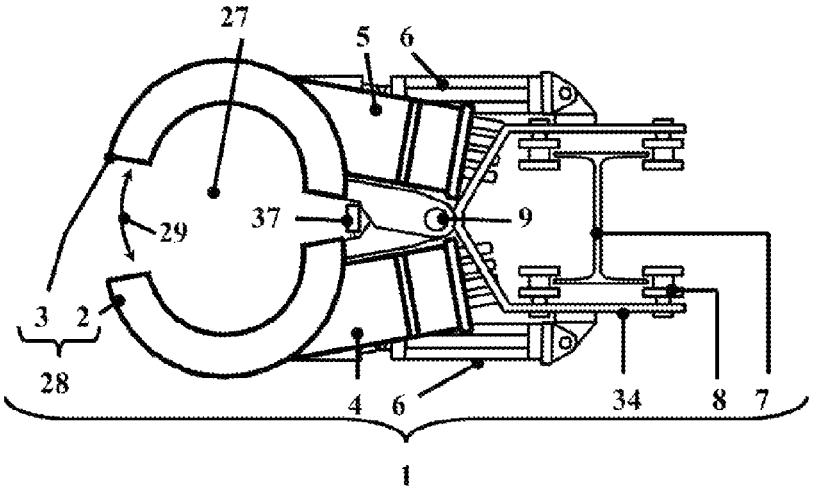
FIG. 4 represents schematically a plan view of the stirrer of FIG. 3 in opening condition of the stirrer body.
Figure 5:
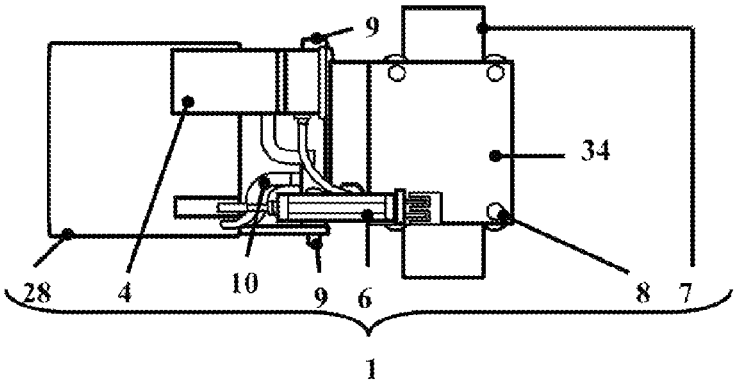
FIG. 5 represents schematically a side-view of the stirrer of FIG. 3.
Figure 6:
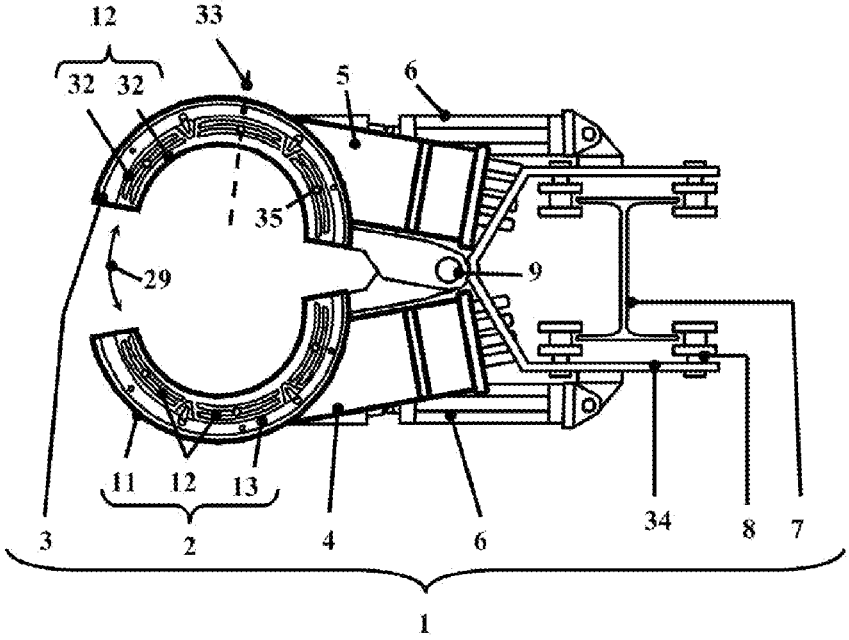
FIG. 6 represents schematically a plan view of the stirrer of FIG. 4 in which the body containing the induction windings has been partially sectioned to leave visible the inside of the same body.
Figure 7:
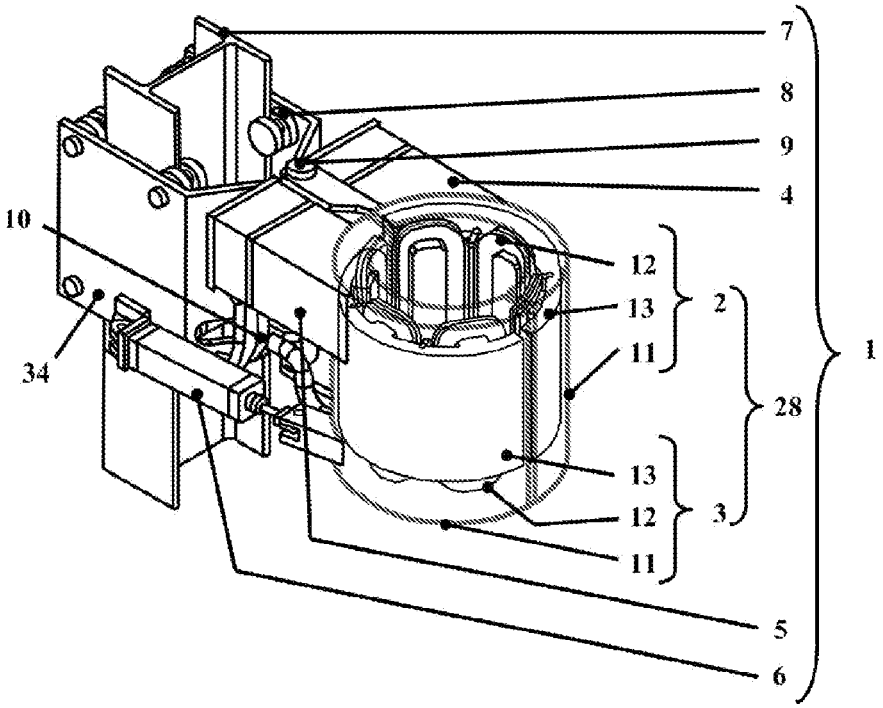
FIG. 7 represents schematically a three-dimensional plan view of the stirrer of FIG. 1 in which the body containing the induction windings has been partially sectioned to leave visible the inside of the same body.
Figure 8:
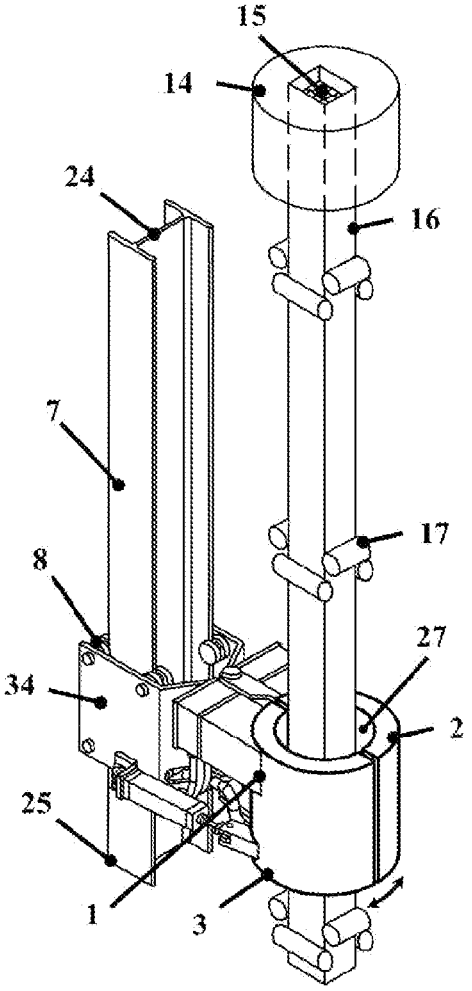
FIG. 8 represents schematically the application of the stirrer according to the present invention in a vertical casting machine in a first operating position in closing condition of the stirrer body.
Figure 9:
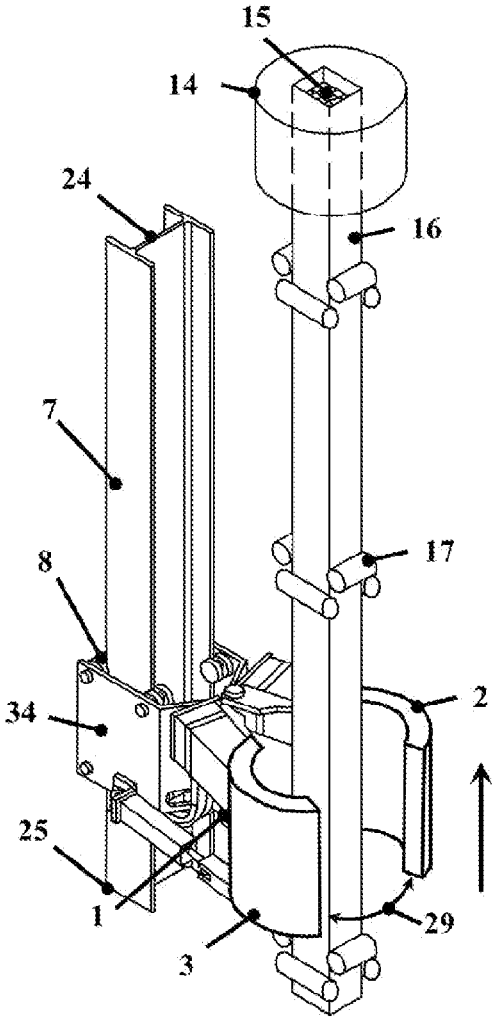
FIG. 9 represents schematically the application of the stirrer according to the present invention in a vertical casting machine in the first position of FIG. 8 in condition of opening the body of the stirrer.
Figure 10:
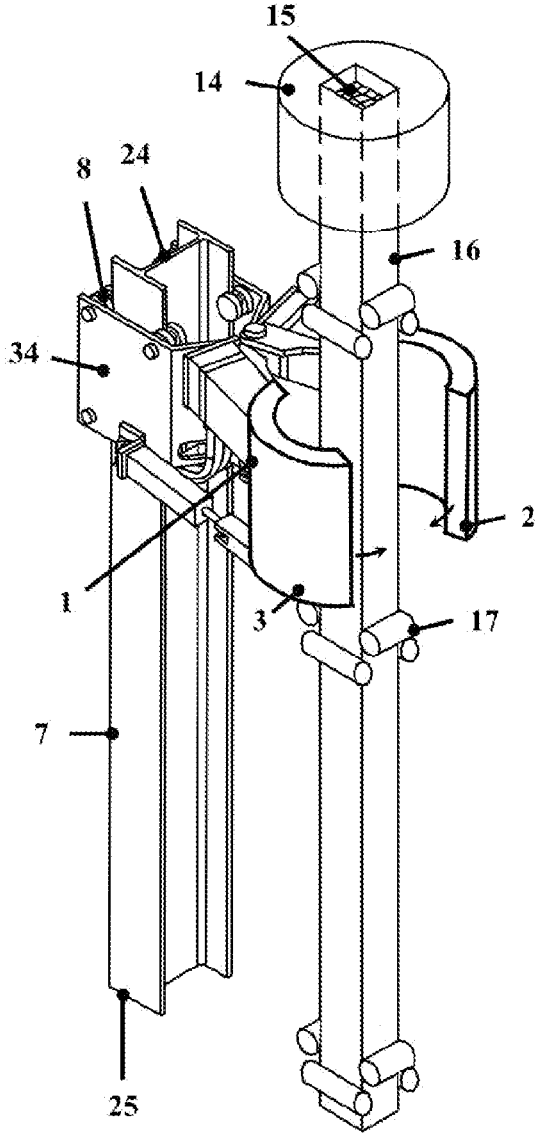
FIG. 10 represents schematically the application of the stirrer according to the present invention in a vertical casting machine in a second position in opening condition of the stirrer body.
Figure 11:
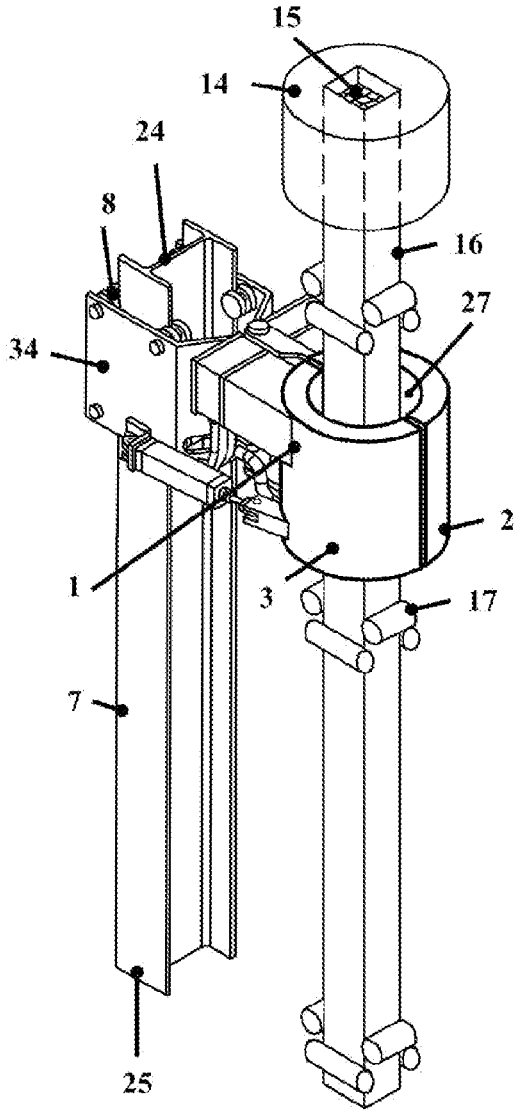
FIG. 11 represents schematically the application of the stirrer according to the present invention in a vertical casting machine in the second position of FIG. 10 in closing condition of the stirrer body.
Figure 12:
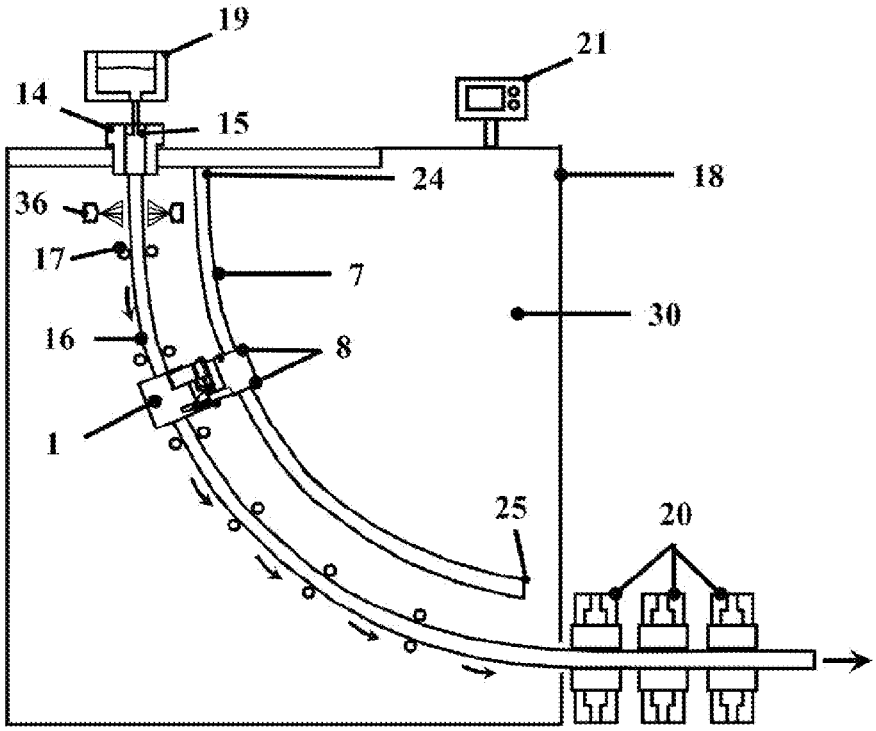
FIG. 12 represents schematically the application of the stirrer according to the present invention in a casting machine endowed with bending in a first operating position.
Figure 13:
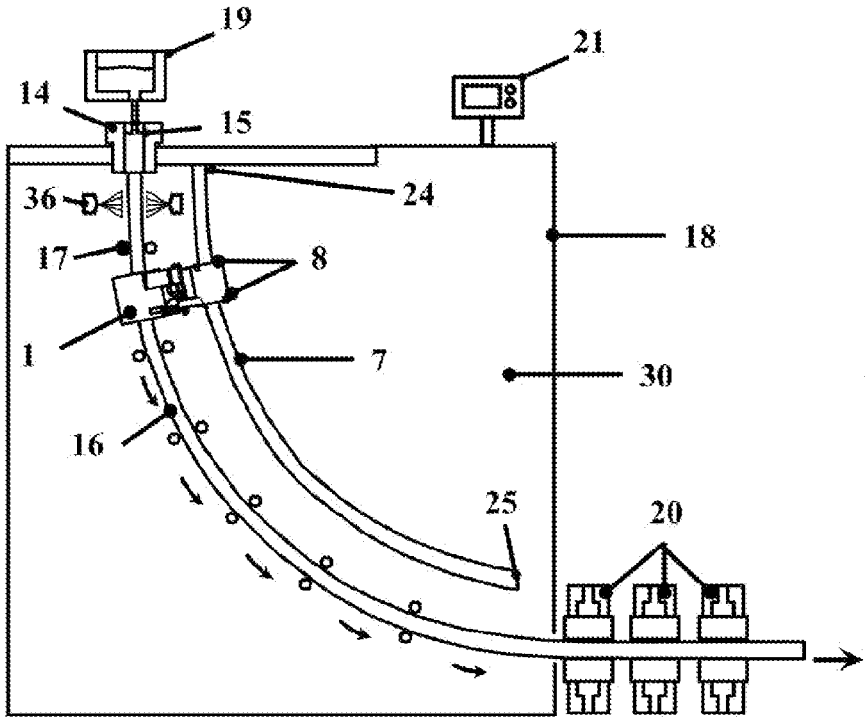
FIG. 13 represents schematically the application of the stirrer according to the present invention in a casting machine endowed with bending in a second operating position.
Figure 14:
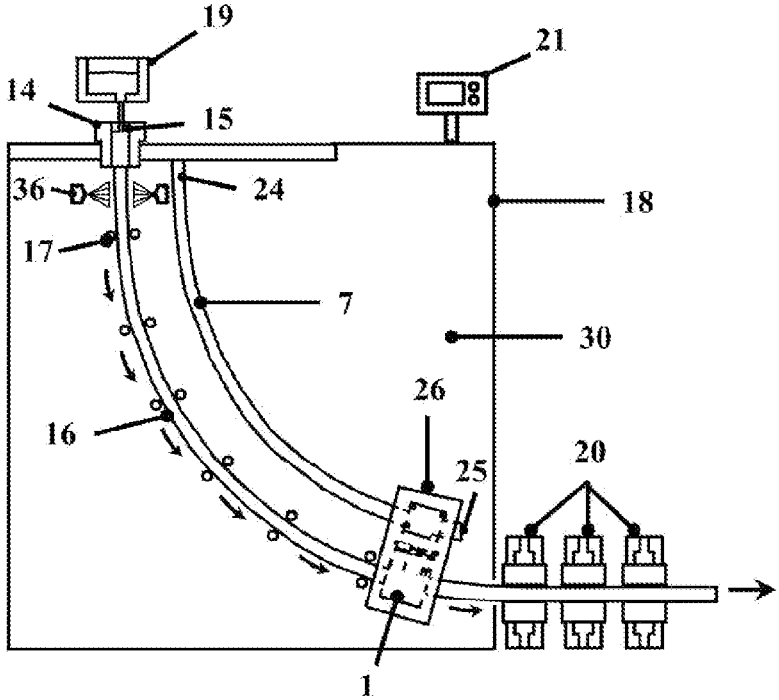
FIG. 14 represents schematically the application of the stirrer according to the present invention in a parking position.
Figure 15:
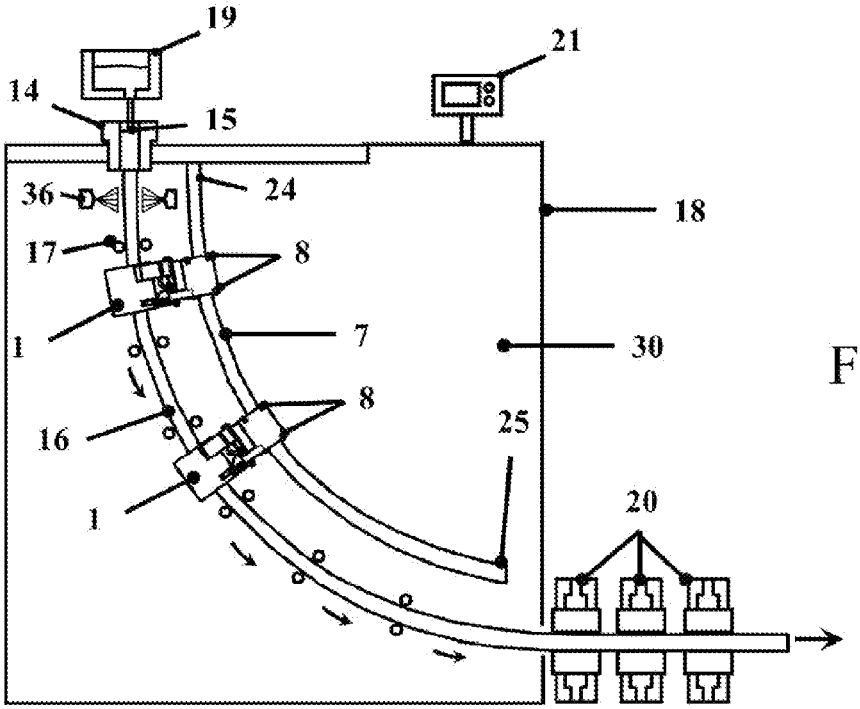
FIG. 15 represents schematically the application of a couple of stirrers according to the present invention in a casting machine equipped with bending in which a first stirrer acts in correspondence with a first operating position and in which a second stirrer acts in correspondence with a second operating position.
Figure 16:
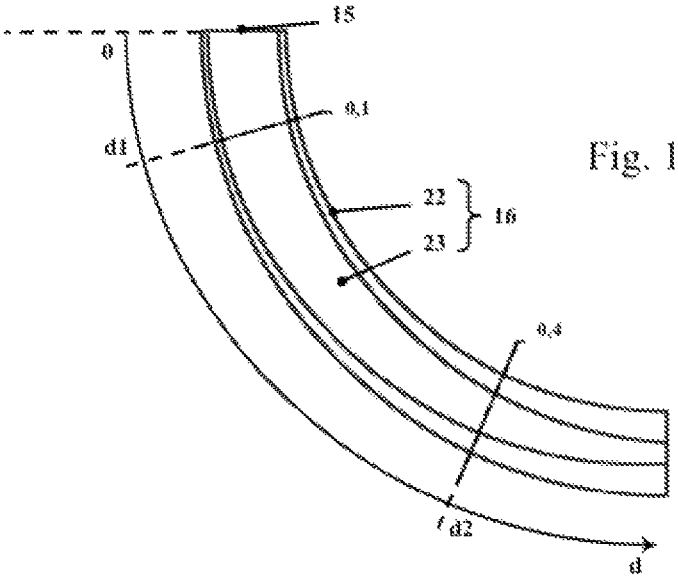
FIG. 16 represents schematically the solidifying profile of a metallic bar in a casting machine endowed with bending.

Referring to the figures (FIG. 1, FIG. 2, FIG. 3, FIG. 4, FIG. 5) the present invention relates to an electromagnetic stirring device (1) of melted metallic material of the type usually called "stirrer". The electromagnetic stirring device (1) according to the present invention is intended to be applied (FIG. 12, FIG. 13, FIG. 14, FIG. 15) within a cooling chamber (30) of a casting machine (18). The application is intended both for vertical type casting machines (FIG. 8, FIG. 9, FIG. 10, FIG. 11) and for casting machines endowed with bending (FIG. 12, FIG. 13, FIG. 14, FIG. 15), namely those in which the melted metallic material is cast from a tundish (19) within a mould (14) placed below the tundish (19) and in which the metallic material bar (16) exits from the mould below according to a vertical exit direction and is then bent to come out horizontally from the casting machine (18) in correspondence with an extraction and straightening group (20) that provides both to the movement of the metallic material bar (16) and to its straightening to obtain rectilinear bars that may be, only as an example and without limitation within the aim of the present invention, billets, blooms or flat blooms with different shapes in section e.g. with square, rectangular, round, polygonal section. Herein description and in the appended claims with the expression "casting machine", therefore are meant both vertical casting machines and casting machines endowed with bending. The electromagnetic stirring device (1) applies a stirring force by means of application of a current generating an electromagnetic field through windings or induction coils (12). With illustrative aim and without limitations with the aim of the present invention the currents generating the electromagnetic field can be alternated currents of frequency between 5 and 50 Hertz with intensity between 300 and 1000 Ampere. The stirring force acts in correspondence with a partially solidified metallic material bar (16) that moves (FIG. 12, FIG. 13, FIG. 14, FIG. 15) within the cooling chamber (30). When the metallic material bar (16) exits from the mould (14) it is not yet in a complete solidified condition but the metallic material bar (16) consists (FIG. 16) of a shell (22) at the solid state enclosing a nucleus (23) at the melted state. The electromagnetic stirring device (1) acts and applies its action by means of the electromagnetic stirring field on the nucleus (23) at the melted state. The electromagnetic stirring device (1) includes (FIG. 1, FIG. 2, FIG. 3, FIG. 4, FIG. 5) a retaining body (28) of the (FIG. 6, FIG. 7) induction coils (12) and the body (28) is supplied with a duct (27) inside the body itself intended to the passage of the metallic material bar (16). With the expression "internal duct" its meant to comprise both a configuration in which the body constitutes a closed shape holding inside the duct, and a configuration in which the body constitutes a shape endowed with possible perimetrical openings and in which the body circumscribes the duct. The body is composed of portions (2, 3) intended to be moved by means of driving means (6) between at least two configurations and further the electromagnetic stirring device (1) is associated and/or associable to driving means (7, 8) of the electromagnetic stirring device (1) along the development in length of the metallic material bar (16). In particular the body (28) is composed of (FIG. 1, FIG. 2, FIG. 3, FIG. 4, FIG. 5) at least two portions (2, 3). Though in the form of execution shown reference is made to a representative and illustrative solution in which there are two portions (2, 3), the present invention is not limited to this embodiment, the body (28) being able to be made also by means of the combination of a greater number of portions, e.g. three portions, four portions, etc. The portions can be both identical and different to one another provided that from their combination derives a body (28) suitable to surround even only partially the metallic material bar (16), if necessary also with open zones between one portion and the following portion in which the open zones have extension in length minor than the extension in length of the same portions. The preferred solution of the present invention, however, provides the recourse to two portions (2, 3).

The portions (2, 3) are intended to be moved by means of driving means (6) between at least two configurations of which:

- a first configuration is a configuration in which the at least two portions (2, 3) are reciprocally close to each other and the body (28) is essentially close and surrounds and defines a duct (27) internal to said body intended for the passage of said metallic material bar (16) for the action of said electromagnetic field on said metallic material bar (16);
- a second configuration is a configuration in which the at least two portions (2, 3) are reciprocally spaced and the body (28) is essentially opened and endowed with at least one opening (29), whose aim will be cleared in the following of the present description.

In the preferred solution of the present invention (FIG. 1, FIG. 8, FIG. 12) the electromagnetic stirring device (1) includes coupling means (8) with a guide (7) intended for the movement of the electromagnetic stirring device (1) along such guide (7). The guide develops (FIG. 8, FIG. 12) in an essentially parallel direction with respect to the metallic material bar (16) that exits from the mould (14) and crosses the cooling chamber (30). The development in length of the guide (7) regards at least one portion of the total development of the metallic material bar (16) within the cooling chamber (30). The electromagnetic stirring device (1) is endowed with and/or is associable to movement motorized means intended for the movement (FIG. 9, FIG. 10) of the device itself along the guide (7) with positioning of the electromagnetic stirring device (1) in different operative positions along the guide (7) intended for the application of the stirring force in correspondence with different positions of the metallic material bar (16). It is understood, therefore, as the solution according to the present invention shows undoubted advantages from the point of view of the fitting-out times of the machine as the positioning of the device in the optimal position, estimated on the base for example of the shape and/or size of the bar, will be particularly fast, particularly at the time of production changes from a casting shape to another casting shape, without requiring the intervention of operators within the casting chamber for the correct positioning of the electromagnetic stirring device (1).

The portions (2, 3) of the body (28) contain (FIG. 6, FIG. 7) a series of induction coils (12). Each series of induction coils (12) can be composed of at least one of these induction coils (2), preferably two induction coils (12), even more preferably three induction coils (12). In the represented illustrative solution each portion (2, 3) includes a series of three induction coils (12) circumferentially placed around the center (31) of the body (28), but it will be evident that also solutions with a greater or minor number of induction coils (12) will be provided in function of the total size of the body (28) and/or of each portion (2, 3). For example in the case of casting machines designed for the execution of small size bars (billets) applications may be provided with one or two or three induction coils for each portion and in the case of casting machines designed for the execution of large size bars (blooms) applications may be provided with three or four or five induction coils for each portion. In similar way also in the case of execution of a body (28) subdivided in more than two portions, e.g. in three or four portions, the number of the coils housed in each portion may be decreasing on the increasing of the number of subdivision portions of the body. The induction coils (12) are preferably structured and configured according to a configuration with couples of induction coils which are opposite (12) with respect to the center (31) of the duct (27), the induction coils (12) being intended to constitute a multi-phase and multi-pole arrangement circumferentially located around the duct (28). If necessary it may be provided also the resort to some portions that are not endowed with coils at their inside but that are intended to constitute coupling elements with the portions endowed with induction coils. Preferably each of these induction coils (12) is composed of at least one pack (32) of windings, preferably two packs or three packs of windings placed adjacent to each other according to a radial direction (33) with respect to the center (31) of the duct (27). In the represented solution (FIG. 6) each of the induction coils (12) is composed of two packs (32) of windings placed one adjacent to the other and mounted on a support (13) housed within a closing housing (11) of the portion in its whole.

In the preferred solution of the present invention the body (28) is composed of two movable portions (2, 3) that are a first portion (2) and a second portion (3) reciprocally hinged at a hinging point (9) in correspondence with one end for the coupling between the two portions. Preferably the portions (2, 3) are reciprocally symmetrical semicircular portions.

In the shown realizable solution (FIG. 4, FIG. 5) the portions (2, 3) are supported by supporting arms (4, 5) intended to be moved by means of said driving means (6). For example in the shown solution a first portion (2) is supported by a first arm (4) and a second portion (3) is supported by a second arm (5). The driving means are preferably at least one driving piston acting on the arms (4, 5) and intended to apply a pushing and/or traction action of an arm (5, 6) with respect to another arm (4, 5). Even more preferably the driving means are at least one driving piston for each of said arms (4, 5) and the piston is intended to act in correspondence with one first end on the corresponding arm and at the opposite end of the piston itself on a supporting frame (34) of the arms (4, 5) in correspondence of the which there is also the hinging point (9).

Though in the form of execution shown the coupling means (8) are a trolley endowed with wheels intended to slide on a guide (7) in the form of a beam with "H" like profile, it will be evident that innumerable embodiments of the guide system of the electromagnetic stirring device (1) that are meant to be included in the aim of the appended claims are possible.

Advantageously the electromagnetic stirring device (1) according to the present invention can also include (FIG. 14) at least one protection housing (26) in correspondence with an end of the guide (7). the protection housing (26) being intended to house inside it the electromagnetic stirring device (1). This solution is particularly advantageous because in case of emergency events the electromagnetic stirring device (1) can be controlled by a control unit (21) for performing an emergency sequence intended to put in safety the same device. For example in case of the phenomenon known with the name of "break-out", namely in the case of breakage of the shell or skin (22) with outflow of the liquid fraction of the nucleus (23) within the casting chamber (30), the electromagnetic stirring device (1) can be controlled for the execution of an emergency procedure in which the portions (2, 3) are rapidly carried in the reciprocally spaced configuration and the electromagnetic stirring device (1) is carried within the protection housing (26) to protect it from squirts or melted material casts preserving its integrity. For example the protection housing (26) can be placed in correspondence with a last end (25) of the guide (7), namely at the last end (25) of the guide that is the opposite end with respect to a first end (24) placed near the mould (14) of the machine (18).

Independently on the presence or less of the protection housing (26) the solution according to the present invention allows important benefits from the point of view of the integrity of the electromagnetic stirring device (1) in the emergency situations because the reciprocal opening of the movable portions (2, 3) in itself already reduces the device heating by radiation. Furthermore the emergency phase can provide, once the reciprocal opening of the movable portions (2, 3) has happened, also the removal of the electromagnetic stirring device (1) from a zone subject to greater heat to a zone subject to less heat and less exposed to the risk of metal squirts, namely from a zone close to the mould to a zone far from the mould and at the most, if necessary but not necessarily, external to the same casting machine.

In the preferred solution of the present invention the body (28) is composed of two movable portions (2, 3) that are a first portion (2) and a second portion (3) reciprocally hinged at a hinging point (9) in correspondence with a coupling end between the two portions. Preferably the portions (2, 3) are reciprocally symmetrical semicircular portions.

Each portion (2, 3) will be endowed with at least one inlet and at least one outlet intended to the feeding of a cooling fluid of the induction coils (12) to discharge the heat coming from the bar (16). The cooling fluid can circulate internally to the portions (2, 3) according to a configuration in which the induction coils (12) are immersed in a flow of this cooling fluid which circulates between the at least one inlet and the at least one outlet and/or according to a configuration in which said cooling fluid circulates internally to a metallic conductor preferably made of copper which is a hollow conductor which is wound according to a circular shape to make such induction coils (12). The cooling fluid can be delivered to the portions (2, 3) by interconnection means (10) with a delivery duct of fluids.

The electromagnetic stirring device (1) can also comprise at least one temperature sensor (35), preferably at least one temperature sensor of (35) for each of the portions (2, 3), even more preferably a temperature sensor (35) for each of the induction coils (12). The temperature sensor (35) is intended for the measurement of temperature of the induction coils (12). Further the electromagnetic stirring device (1) can comprise also emergency opening means (37) of the portions (2, 3). The emergency opening means (37) being intended to move the portions (2, 3) from the first configuration in which the portions (2, 3) are reciprocally close to the second configuration in which the portions (2, 3) are reciprocally spaced. This solution is particularly advantageous in case of lack of suitable cooling fluid that could bring to a raising of the temperature with damage for the induction coils (12) or in case of interruption of the feeding of the electric power to the casting machine. In this condition usually is maintained only the circulation of the cooling fluid closely necessary to manage the maximum emergency conditions of this situation and, therefore, the electromagnetic stirring device (1) would be exposed to the heat coming from the bar (16) without suitable cooling. The opening of the portions would increase the distance of the coils from the incandescent bar preserving the same coils. Furthermore it may be provided also the release of braking devices of the device so that it, by gravity, will move to a position of the guide where the bar has a lower temperature. For example the emergency opening means (37) can include activation means intended to control said emergency opening means (37) following the exceeding of a temperature threshold measured by means of the temperature sensor/s (35). The activation means can be directly managed on the device to manage also the case of lack of electric power in the casting machine and/or can be managed by the control unit (21). The control unit (21) can be indifferently made in the form of a personal computer, a personal industrial computer or a programmable logic controller (PLC), a dedicated electronic card or equivalent means. The emergency opening means (37) can include, for example, pushing means in the form of elastic mechanical means and/or pushing springs and/or pushing means in the form of pushing piston operated by container of air or gas, possibly a noble gas.

This invention relates also to a casting machine (18) for the production of metallic material bars (16) in which the metallic material at the melted state is cast (FIG. 12) from a tundish (19) within a mould (14) placed below the tundish (19) and in which the metallic material bar (16) exits from the mould (14) below the same to come across a cooling chamber (30) and characterised in that it comprises at least one of the electromagnetic stirring devices (1) made according to the present invention within such cooling chamber (30). The casting machine (18) can comprise even more than one of the inventive electromagnetic stirring devices (1), e.g. at least two, for example two or three or more, of these electromagnetic stirring devices (1), each of these electromagnetic stirring devices (1) comprising the previously described coupling means (8) with a corresponding guide (7) or intended to be moved independently one from the other and/or coordinated with each other along a same common guide (7). This solution is advantageous because one of the electromagnetic stirring devices (1) can perform an action in the first section of the bar and the other can perform its action in the zone of the bar foot, namely the closest zone to the exit of the bar from the casting machine with the advantage that both can be placed in optimal position with respect to the casting parameters and further with the advantage that both can be carried in protected position in case of emergency.

This invention relates also to a casting process for the production of metallic material bars (16) comprising a casting phase in which the metallic material is cast within a mould (14) of the casting machine (18) for extracting the metallic material bar (16) from the mould (14), the metallic material bar (16) exiting from the mould (14) being partially solidified and moving within the cooling chamber (30). The process provides one or more stirring phases of the material at the melted state constituting the nucleus (23) of the metallic material bar (16) within the cooling chamber (30) and the stirring phase of the material at the melted state constituting such nucleus occurs by means of at least one of the inventive electromagnetic stirring devices (1).

The casting process can include at least one movement phase of one or more of these electromagnetic stirring devices (1) by said movement means (7, 8), for example along the respective guide (7), this movement phase happening before of the starting of this casting phase and/or during the casting phase.

In the casting process according to the present invention, the movement phase can provide the following steps for at least one of the inventive electromagnetic stirring devices (1):

- activation of the driving means (6) with movement of the at least two portions (2, 3) from the first configuration in which the at least two portions (2, 3) are reciprocally close to the second configuration in which the at least two portions (2, 3) are reciprocally spaced;
- activation of the motorized means of movement intended for the movement of the electromagnetic stirring device (1) along the guide (7) with displacement along this guide (7) of the electromagnetic stirring device (1) itself from a first operative position to a second operating position different with respect to this first operating position;
- activation of the driving means (6) with movement of the at least two portions (2, 3) from the second configuration in which the at least two portions (2, 3) are reciprocally spaced to the first configuration in which the at least two portions (2, 3) are reciprocally close.

In the casting process according to this invention such second operating position will be preferably determined at least for one of the electromagnetic stirring devices (1) referring to the distance (d) from the meniscus (15) and/or referring to an equivalent reference point of the casting machine. The meniscus (15) is the interface within the mould (14) constituting the starting of the formation of the bar (16) and corresponding to the level at which the metallic material poured at the melted state is maintained within the mould (14). The reckoning of the operative position will occur preferably on the base of parameters and data describing the casting process including estimated cooling curve of the metallic material bar (16) and/or shapes in section of the metallic material bar (16) and/or size in section of the metallic material bar (16) and/or casting or extraction speed and/or temperature of the metallic material within the mould (14) and/or temperature of the metallic material within the tundish (19) feeding the metallic material at the melted state within the mould (14) and/or temperature of the metallic material within the ladle (not represented) feeding the metallic material at the melted state within the tundish (19) and/or composition of the metallic material at the melted state and/or temperature of the cooling water of the metallic material at the melted state within the mould (14) and/or operative parameters of the casting process.

Figure 17:
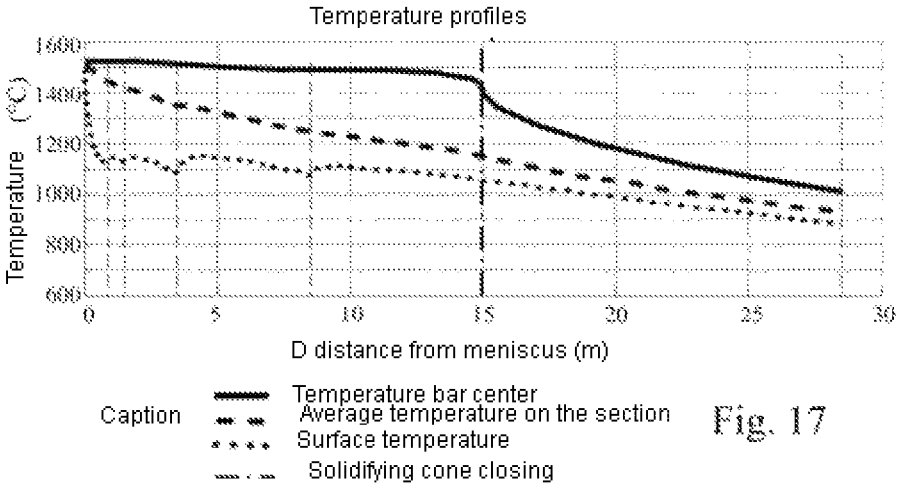
FIG. 17 represents a chart showing the temperature profile of a metallic bar in a casting machine according to the distance from the meniscus.
Figure 18:
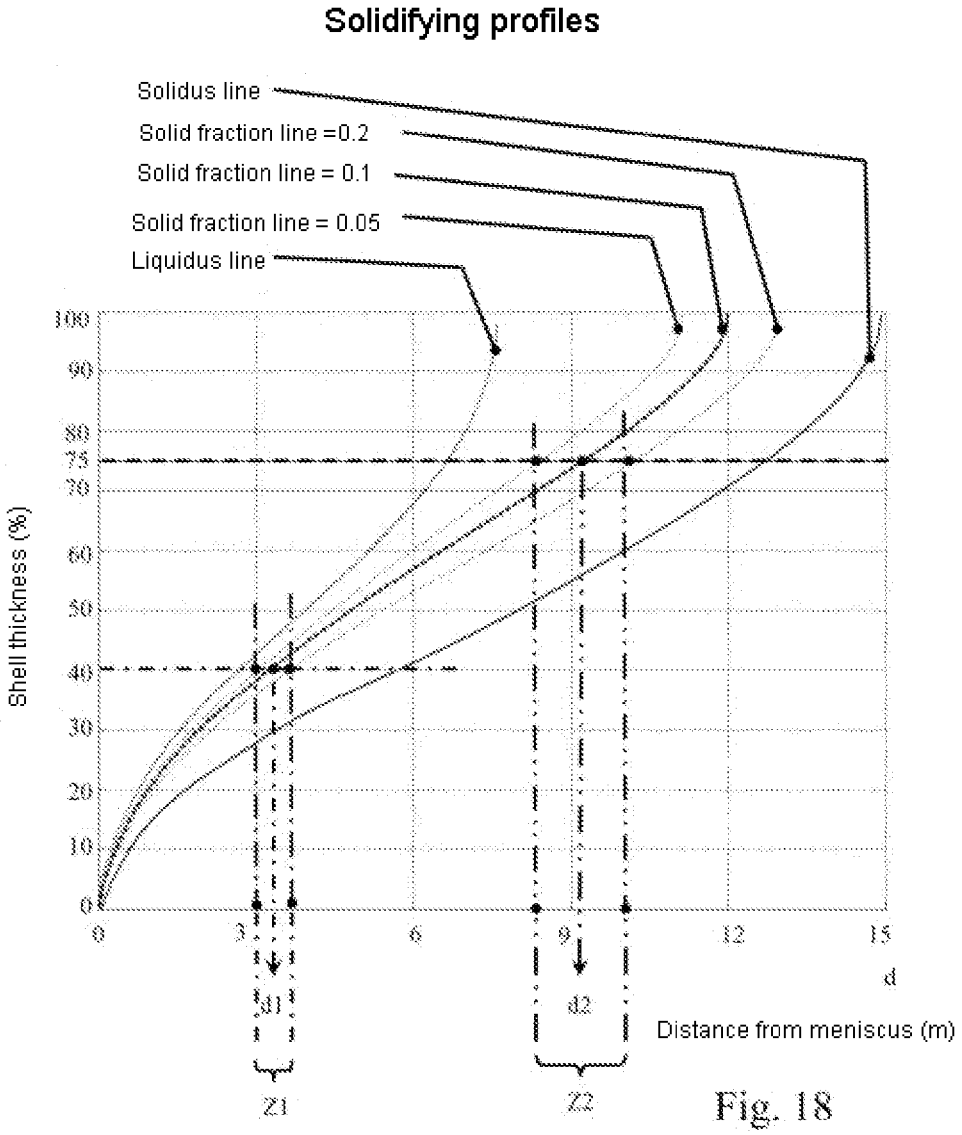
FIG. 18 represents a chart showing the solidifying profile of a metallic bar in a casting machine according to the distance from the meniscus.

For example the optimal operative positions can be determined according to the estimation of the ratio between solid fraction and liquid fraction of the partially solidified metallic material bar (16) in correspondence with such operative positions, the solid fraction corresponding to the estimated extension of the shell (22) and the liquid fraction corresponding to the estimated extension of the nucleus (23). In particular (FIG. 18) following the line of solidus it can be seen as the reaching of the condition in which 100% of solidifying occurs, in the illustrative chart, at a distance (d) of about fifteen meters from the meniscus (15). The solidifying profile can be estimated by a calculation according to the previously indicated parameters according to prior art and, once determined the percentage of solidus (or equivalently the percentage of liquidus or equivalently the ratio between liquid fraction and solid fraction or vice-versa) corresponding to the optimal position for applying the device (1), it will be possible to identify the corresponding optimal position expressed in terms of distance (d) from the meniscus (15), that in the chart (FIG. 18) is in the abscissas. Consequently it will be possible to provide to the movement of one or more devices (1) to place them in the optimal operative positions. In similar way also by means of the estimated temperature profile (FIG. 17) it will be possible to carry out an equivalent evaluation for determining the distance (d) from the meniscus (15) at which one or more devices (1) will be placed according to positions comprised between the exit position of the bar from the mould (14) and the position in which the closure of the solidifying cone occurs, namely the position in which the condition for solidifying the nucleus is reached.

For example at least one first of such operative positions may correspond to a determined value of the relation between solid fraction and liquid fraction in which the thickness of the shell (22) is between 20% and 60% with respect to the thickness of the metallic material bar (16), preferably between 30% and 50%, even more preferably about 40%.

For example at least one second of said operative positions corresponds to a value of the ratio between solid fraction and liquid fraction in which the thickness of the shell (22) is between 65% and 85% with respect to the thickness of the metallic material bar (16), preferably between 70% and 80% even more preferably about 75%.

EXAMPLE 1

The temperature (FIG. 17) and solidifying profiles (FIG. 18) are estimated starting from the casting parameters relative to the casting of a C40 type steel that is poured within a square mould with side of 160 mm with the following parameters:

Mould section: 160×160 mm . . . Steel type: C40

Casting speed: 2.00 m/min . . . Steel range: 401.92 kg/min

Metallurgic length: 14.90 m . . . Temperature in tundish: 1522° C.

Liquidus temperature: 1492° C. Solidus temperature: 1439° C.

Cooling of first zone of the secondary cooling part with 65 l/min on 0.6 meters range Cooling of second zone of the secondary cooling part with 110 l/min on 2.0 meters range Cooling of the third zone of the secondary cooling part with 58 l/min on 5.0 meters range On the solidifying profile (FIG. 18) the shell thickness is selected corresponding to a first position of application of one first of the electromagnetic stirring devices (1), for example in correspondence with a thickness shell equal to 40%. It is obtained a first zone (Z1) that constitutes the optimal positioning zone of the first electromagnetic stirring device (1). This first zone (Z1) is identified as the zone comprised between a first value in abscissa that corresponds to the point of intersection between the horizontal straight line corresponding to the thickness of the shell of 40% and the solid fraction line equal to 0.05 and a second value in abscissa that corresponds to the point of intersection between the horizontal straight line corresponding to the shell thickness of 40% and the solid fraction line equal to 0.2. In the example represented the first zone (Z1) is approximately comprised between the points having a distance from the meniscus equal to 3 meters and 3.8 meters. The first optimal point (d1), namely the one corresponding to the position of the first electromagnetic stirring device (1) in correspondence with the point in which the estimated shell thickness is equal to 40% is the one corresponding to the point of intersection between the horizontal straight line corresponding to the shell thickness of 40% and the solid fraction line equal to 0.1. In the example represented the first optimal point (d1) is approximately placed at a distance from the meniscus equal to 3.2 meters. During the casting this evaluation can be repeated in a continuous or discrete way in order to change the position of the first electromagnetic stirring device (1) according to the variation of one or more of the previously listed calculation parameters.

EXAMPLE 2

On the basis of the data reported for the example 1, on the solidifying profile (FIG. 18) the shell thickness is selected corresponding to a second application position of a second one of the electromagnetic stirring devices (1), for example in correspondence with a shell thickness equal to 75%. It is obtained a second zone (Z2) that constitutes the optimal positioning zone of the second electromagnetic stirring device (1). This second zone (Z2) is identified as the zone comprised between a first value in abscissa that corresponds to the point of intersection between the horizontal straight line corresponding to the shell thickness of 75% and the solid fraction line equal to 0.05 and a second value in abscissa that corresponds to the point of intersection between the horizontal straight line corresponding to the shell thickness of 75% and the solid fraction line equal to 0.2. In the example represented the second zone (Z2) is approximately comprised between the points having a distance from the meniscus equal to 8.4 meters and 10 meters. The second optimal point (d2), namely the one corresponding to the position of the second electromagnetic stirring device (1) in correspondence with the point in which the estimated shell thickness is equal to 75% is the one corresponding to the point of intersection between the horizontal straight line corresponding to the shell thickness of 75% and the solid fraction line equal to 0.1. In the example represented the second optimal point (d2) is approximately placed at a distance from the meniscus equal to 9.2 meters. During the casting this evaluation can be repeated in a continuous or discrete way in order to change the position of the second electromagnetic stirring device (1) according to the variation of one or more of the previously listed calculation parameters.

EXAMPLE 3

On the basis of the example 2, the influence on the optimal positioning of the second electromagnetic stirring device (1) has been valued according to the type of steel and casting rate, estimating the corresponding solidifying sections and obtaining the results reported in the following in Table 1.

TABLE 1

| SQUARE SECTION 160 | | |
|---|---|---|
| Steel type | Casting speed [m/min] | Optimal position d2 Distance from meniscus [m] |
| 35KB | 1.8 | 10.3 |
| | 2.0 | 11.6 |
| C40 | 1.8 | 10.0 |
| | 2.0 | 11.4 |
| 16MnCr5 | 1.8 | 10.6 |
| | 2.0 | 12.1 |

EXAMPLE 4

On the basis of the example 2, the influence on the optimal positioning of the second electromagnetic stirring device (1) has been valued according to the type of steel and casting speed for a different size in section of the metallic bar that in this case has square section with a side of 180 mm instead than of 160 mm. By way of example it should be pointed out that in this case also other operative parameters change e.g. the cooling ranges to keep into account the greater size of the metallic material bar.

Cooling of first zone of the secondary cooling part with range of 82 l/min on 0.6 meters Cooling of second zone of the secondary cooling part with range of 139 l/min on 2.0 meters Cooling of third zone of the secondary cooling part with range of 73 l/min on 5.0 meters estimating the corresponding solidifying profiles and obtaining the results reported in the following in

TABLE 2

| SQUARE SECTION 180 | | |
|---|---|---|
| Steel type | Casting speed [m/min] | Optimal position d2 Distance from meniscus [m] |
| 35KB | 1.8 | 10.3 |
| | 2.0 | 11.6 |
| C40 | 1.8 | 10.0 |
| | 2.0 | 11.4 |
| 16MnCr5 | 1.8 | 10.6 |
| | 2.0 | 12.1 |

As it can be seen from the tables the optimal position of the electromagnetic stirring device (1) may change also considerably according to the steel type, to the casting speed, to the section of the metallic material bar. Therefore it is understood that the advantage of the electromagnetic stirring device (1) according to the present invention both in the case in which the movement is used during the first phase of the casting machine fitting-out, which is carried out in function of the type of steel that must be cast, and in the case in which the movement is used during the casting for adapting the position of the device itself with respect to the real casting parameters that can suffer also important variations with respect to the initially provided parameters. It follows that the consequences of the present invention in terms of speed of the fitting-out time of the machine and of quality of the produced steel are important.

Advantageously the operative positions are determined in a continuous way along the development of the metallic material bar (16) within the cooling chamber (30) according to the previously enunciated parameters and data describing the casting process and according to the presence of interference zones with accessories (17, 36) of the casting machine (18) precluding the positioning of the electromagnetic stirring devices (1) in correspondence with such interference zones. In fact though the solution according to the present invention allows to obtain a positioning in a continuous way along the bar in the process of solidifying it is necessary to observe that not all the positions are actually practicable because of the presence, for example, of sprayers (36) or rollers (17) that could interfere with the device (1). In addition to the safeguard of the coils (12) in the emergency conditions, therefore, the solution according to the present invention with portions (2, 3) which may be reciprocally spaced or drawn closer on the bar (16), also allows to obtain the maximum stirring effect in the condition with the portions (2, 3) drawn closer that corresponds to the highest filling factor of the duct (27) and at the same time allows the movement of the device between positions placed on opposite sides with respect to such accessories (17, 36) that preclude the positioning of the electromagnetic stirring devices (1) and that could be damaged by the passage of the same devices if they were not equipped with the opening system described.

Furthermore in the casting process the stirring phase of the material at the melted state constituting the nucleus of the bar can happen by means of at least two of these electromagnetic stirring devices (1), this casting process comprising stirring phases of the material at the melted state constituting the nucleus in which:

a first phase provides the disjoined action of these electromagnetic stirring devices (1) in reciprocally spaced operative positions (FIG. 15) along the total development of the metallic material bar (16) within the cooling chamber (30);

a second phase provides the combined action of at least two of these electromagnetic stirring devices (1) in reciprocally close operative positions along the total development of the metallic material bar (16) within the cooling chamber (30), such at least two electromagnetic stirring devices (1) which operate in combination one next to the other with effect of combination and interaction of the respective electromagnetic fields generating the stirring force, each of these at least two electromagnetic stirring devices (1) being controlled with a generation signal of the electromagnetic field at a determined operative frequency, the operative frequencies of these electromagnetic stirring devices (1) in reciprocally close operative positions being selected from the group consisting of identical frequencies for all such electromagnetic stirring devices (1), slightly different frequencies for each of these electromagnetic stirring devices (1) with respect to the operative frequency of the adjacent electromagnetic stirring device (1), different frequencies for each of these electromagnetic stirring devices (1) with respect to the operative frequency of the adjacent electromagnetic stirring device (1).

Figure 19:
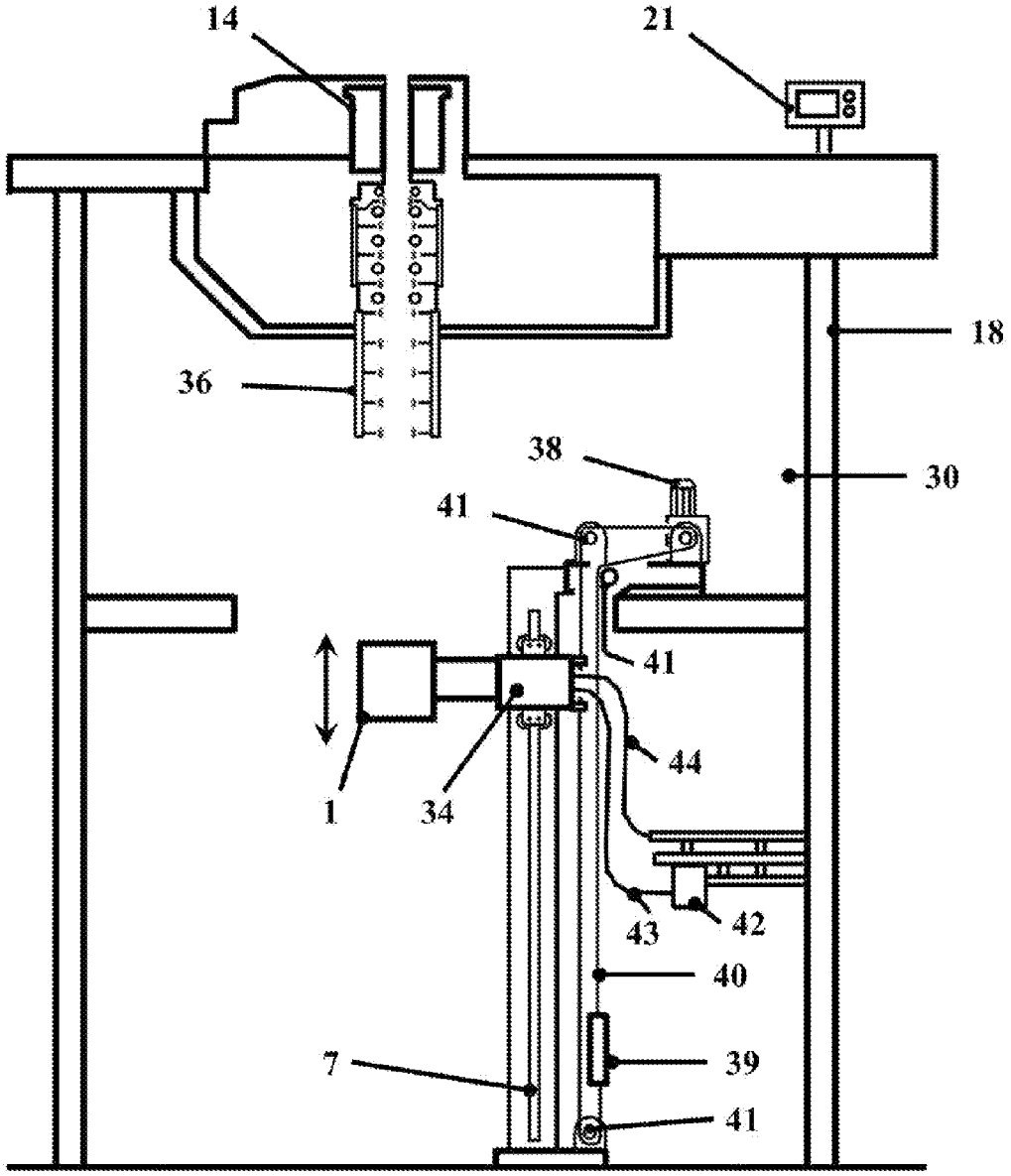
FIG. 19 represents schematically the application of a stirrer according to the present invention in a vertical casting machine in which also a possible embodiment of the movement system is shown.

The movement system (FIG. 19) according to one embodiment can include a motor (38) acting on a traction means (40) that for example can be made by a cable or equivalent means that are made pass in a series of pulleys (41) and to which a counterweight (39) is fixed in order to reduce the effort of the motor. This solution presents the advantage that allows to position the motor and the transmission devices in a protected position, at the most even outside of the casting chamber or anyway in a destined space situated within the same. In this way in case of problems, e.g. steel squirts due to a breakage of the skin of the bar, the motor and the transmission devices will be advantageously protected either due to the position far from the bar or to the possible presence of a protection space. It will be however evident that it will be possible to provide also other types of movement systems as, e.g. rack structures, telescopic systems that are considered as equivalent movement means with the aim of the present invention.

The connection of the electrical users of the electromagnetic stirring device (1) preferably occurs by means of a connection box (42) placed in protected position and preferably near the intermediate position with respect to the complete excursion of the movement of the electromagnetic stirring device (1) along the guide (7). The connection can happen by means of one or more electric cables (43) of flexible type in order to ensure the liberty of movement of the electromagnetic stirring device of (1) along the guide (7), possibly by means of the passage in a fairlead chain (not represented). In an absolutely similar way the connection of the hydraulic users can happen by means of one or more flexible pipes for fluids (44) for feeding a cooling fluid of the induction coils (12) to discharge the heat coming from the bar (16).

The description of the present invention has been done with reference to figures enclosed in a form of preferred embodiment of the same, but it is evident that many possible alterations, changes and variants will be immediately clear to those skilled in the art of the sector in view of the previous description. So, it should be stressed that the invention is not limited by the previous description, but contains all alterations, changes and variants in accordance with the appended claims.

USED NOMENCLATURE

With reference to the identification numbers reported in the enclosed figures, it has been used the following nomenclature:

1. Stirrer device or electromagnetic stirring device
2. First portion
3. Second portion
4. First arm
5. Second arm
6. Driving means or piston
7. Guide
8. Coupling means
9. Hinging
10. Interconnection means
11. Casing
12. Winding or induction coil
13. Support
14. Mould
15. Meniscus
16. Metallic bar or metallic material bar
17. Roller
18. Casting machine
19. Tundish
20. Extraction and straightening group
21. Control unit
22. Solid fraction or shell or skin
23. Liquid fraction or nucleus
24. First end
25. Last end
26. Protection housing
27. Duct
28. Body
29. Opening
30. Cooling chamber
31. Center
32. Pack of windings
33. Radial direction
34. Frame
35. Temperature sensor
36. Sprayers
37. Opening means in emergency
38. Motor
39. Counterweight
40. Traction means
41. Pulley
42. Connection box
43. Electric cable
44. Flexible pipe for fluids d. distance from the meniscus

The invention claimed is:

1. An electromagnetic stirring apparatus for storing melted metallic materials inside of a cooling chamber of a casting machine, the electromagnetic stirring apparatus comprising:

a plurality of induction coils that apply a current so as to generate an electromagnetic field so as to apply a stirring force, the stirring force acting in correspondence with a partially solidified metallic bar that moves through the cooling chamber, the partially solidified metallic bar having a solid shell that encloses a nucleus that is in a melted state, the nucleus being subject to the electromagnetic field;

a retaining body that retains said plurality of induction coils, said retaining body having a duct therein, said duct adapted to allow a passage of the metallic bar, said retaining body having portions;

a driver cooperative with said portions of said retaining body between at least two configurations;

a movement device cooperative with the metallic bar and adapted to move the electromagnetic stirring device along a guide and along a length of the metallic bar in a direction parallel to the metallic bar for at least a portion of the length of the metallic bar in a different operative position with respect to the metallic bar.

2. The electromagnetic stirring apparatus of claim 1, said portions of said retaining body comprising at least two portions which are adapted to be moved by said driver between at least a pair of configurations, said pair of configurations having a first configuration in which the at least two portions of said retaining body are reciprocally close to each other and wherein said retaining body is an essentially closed body which surrounds and defines said duct internal of said body, and a second configuration in which the at least two portions of said retaining body are reciprocally spaced and in which said retaining body is an essentially open body having at least one opening.

3. The electromagnetic stirring apparatus of claim 2, further comprising:

an emergency opener cooperative with said portions of said retaining body, said emergency opener adapted to move said portions from said first configuration in which said portions are reciprocally close to said second configuration in which said portions are reciprocally spaced.

4. The electromagnetic stirring apparatus of claim 3, said emergency opener including a pusher.

5. The electromagnetic stirring apparatus of claim 3, said emergency opener including an activator that is adapted to control said emergency opener relative to a detection of a lack of cooling fluid or a detection of an excessive temperature.

6. The electromagnetic stirring apparatus of claim 1, said movement device includes a coupler adapted to couple with said guide, said movement device adapted to move the electromagnetic stirring apparatus along said guide, said guide extending in an essentially parallel direction with respect to the metallic bar for at least a portion of a total length of the metallic bar within the cooling chamber, the electromagnetic stirring apparatus further comprising:

a motor cooperative with said guide in different operative positions along said guide, said motor adapted to apply movement of said electromagnetic stirring device in correspondence with different positions along said guide which are intended for the application of the stirring force in correspondence with different positions of the metallic bar.

7. The electromagnetic stirring apparatus of claim 6, said motor operating on a cable passing along a series of pulleys, said cable having a counterweight adapted to reduce an effort of said motor, said cable being adapted to transmit a traction action applied by said motor.

8. The electromagnetic stirring apparatus of claim 1, said portions of said retaining body containing a series of induction coils of said plurality of induction coils, said plurality of induction coils being configured in couples which are opposite to each other with respect to a center of said duct, each of said plurality of induction coils having a multi-phase and multi-pole arrangement which is circumferentially arranged around said duct.

9. The electromagnetic stirring apparatus of claim 1, wherein each of said plurality of induction coils being composed of at least one pack of windings which are placed adjacent to each other in a radial direction with respect to a center of said duct.

10. The electromagnetic stirring apparatus of claim 1, said portions of said retaining body being a pair of portions.

11. The electromagnetic stirring apparatus of claim 10, said pair of portions comprising a first portion and a second portion which are reciprocally hinged at a hinging point.

12. The electromagnetic stirring apparatus of claim 10, said pair of portions each being a reciprocally symmetrical semicircular portion.

13. The electromagnetic stirring apparatus of claim 1, said portions of said retaining body being supported by supporting arms that are adapted to be moved by said driver, said driver having at least one driving piston acting on said supporting arms so as to apply a pushing action or a traction action onto one of the arms with respect to another of the arms.

14. The electromagnetic stirring apparatus of claim 1, said movement device having a trolley provided with wheels, said trolley being slidable on said guide.

15. The electromagnetic stirring apparatus of claim 1, further comprising:

at least one protection housing corresponding to an end of said guide, said protection housing adapted to house the electromagnetic stirring apparatus therein.

16. The electromagnetic stirring apparatus of claim 1, each of said portions comprising at least one inlet and at least one outlet which are adapted to feed a cooling fluid to the plurality of induction coils, said cooling fluid being adapted to circulate within said portions in accordance with the configuration of plurality of induction coils, said plurality of induction coils being immersed in a flow of the cooling fluid that circulates between said at least one inlet and said at least one outlet.

17. A casting machine for production of metallic metal bars comprising a cooling chamber having at least one electromagnetic stirring apparatus of claim 1.

18. The casting machine of claim 17, in which the cooling chamber has at least two of the electromagnetic stirring apparatus of claim 1.

19. The casting machine of claim 18, wherein said electromagnetic stirring apparatus comprises at least two of the electromagnetic stirring apparatuses are movable along said guide independent of each other or coordinated with each other.

20. A casting process for the production of metallic bars, the casting process comprising:

pouring metallic material into a mold of a casting machine;

extracting the metallic bar from said mold such that said metallic bar exits said mold in a partially solidified state, said metallic bar moving within a cooling chamber, the metallic bar having a shell which is in a solid state and encloses a nucleus that is in a melted state; and stirring the nucleus with at least one electromagnetic stirring apparatus, the at least one electromagnetic stirring apparatus comprising:

a plurality of induction coils that apply current so as to generate an electromagnetic field so as to apply a stirring force, the stirring force acting in correspondence with the nucleus of the metallic bar that moves through the cooling chamber;

a retaining body that retains said plurality of induction coils, said retaining body having a duct therein, said duct adapted to allow a passage of the metallic bar, said retaining body having portions;

a driver cooperative with said portions of said retaining body between at least two configurations; and a movement device cooperative with the metallic bar and adapted to move the at least one electromagnetic stirring apparatus along a guide and along the length of the metallic bar in a direction parallel to the metallic bar for at least a portion of the length of the metallic bar and in different operative positions with respect to the metallic bar.

21. The casting process of claim 20, further comprising:

moving the at least one electromagnetic stirring apparatus prior to the step of pouring.

22. The casting process of claim 21, the step of moving comprising:

activating the driver by moving the portions from a first configuration in which the portions are reciprocally close to each other and a second configuration in which the portions are reciprocally spaced from each other;

activating a motor so as to move the at least one electromagnetic stirring apparatus along the guide with a displacement of the at least one electromagnetic stirring apparatus on the guide from a first operating position to a second operating position, the second operating position being different than the first operating position; and activating the driver by moving the portions from the second configurations to the first configuration.

23. The casting process of claim 22, wherein the second operating position is determined for the at least one electromagnetic stirring apparatus relative to a distance from the nucleus in correspondence to a level of the metallic material that is poured within said mold.

24. The casting process of claim 22, the operative positions being determined according to a ratio between a solid fraction and a liquid fraction of the metallic bar in accordance with a thickness of said shell, the solid fraction corresponding to an estimated extension of said shell and the liquid fraction corresponding to an estimated extension of said nucleus.

25. The casting process of claim 22, a first of said operative positions corresponding to a position along the metallic bar in which a thickness of said shell is between 20% and 60% relative to a thickness of the metallic bar.

26. The casting process of claim 25, another of the operative positions corresponding position along the metallic bar in which a thickness of said shell is between 65% and 85% relative to a thickness of the metallic bar.

27. The casting process of claim 22, wherein the operative positions are determined continuously along a development of a length of the metallic bar within the cooling chamber.

28. The casting process of claim 20, wherein a stirring of the melted state of the nucleus has a first phase that provides a separating action between at least two electromagnetic stirring apparatuses in the operative positions which are reciprocally spaced along a development of the metallic bar within the cooling chamber, a second phase which combines an action of the at least two of said electromagnetic stirring apparatuses in reciprocally close operative positions along a total development of the metallic bar within said cooling chamber, the at least two electromagnetic stirring apparatuses operating in combination adjacent to each other so as to have a combination and interaction effect of respective electromagnetic fields that generate the stirring force, each of the at least two electromagnetic apparatuses being controlled by a generation signal of the electromagnetic field at a determined operative frequency, the operative frequencies of the least two electromagnetic stirring apparatuses that are in the reciprocally close operative positions selected from the group consisting of identical frequencies for all of the at least two electromagnetic stirring apparatuses, and different frequencies for each of the at least two electromagnetic stirring apparatuses with respect to the operative frequency of the adjacent electromagnetic stirring apparatuses.

* * * * *